US006338167B1

(12) United States Patent
Baker et al.

(10) Patent No.: US 6,338,167 B1
(45) Date of Patent: Jan. 15, 2002

(54) DETACHABLE TOILET SEAT

(76) Inventors: Richard H. Baker, 26 Wildwood Dr., Bedford, MN (US) 01730; Krista K. Finigan, 38 Evans Rd., Marblehead, MA (US) 09145; Anthony G. P. Marini, 93 Highland St., Clinton, MA (US) 01510

( * ) Notice: Subject to any disclaimer, the term of this patent is extended or adjusted under 35 U.S.C. 154(b) by 0 days.

(21) Appl. No.: 09/444,090

(22) Filed: Nov. 22, 1999

Related U.S. Application Data

(60) Provisional application No. 60/109,372, filed on Nov. 23, 1998.

(51) Int. Cl.[7] ..... A47K 13/00
(52) U.S. Cl. ..... 4/234; 411/339
(58) Field of Search ..... 4/234, 236, 237, 4/240; 411/268, 269, 338, 339

(56) References Cited

U.S. PATENT DOCUMENTS 597,823 A * 1/1898 Muphy ..... 411/269
904,341 A * 11/1908 Lindstrom ..... 411/269 X
3,063,063 A * 11/1962 Brooks ..... 4/236
3,613,130 A * 10/1971 Sansone ..... 4/240
5,457,824 A * 10/1995 Reed ..... 4/234

* cited by examiner

*Primary Examiner*—Charles E. Phillips
(74) *Attorney, Agent, or Firm*—Charles G. Call

(57) ABSTRACT

This invention is related generally to detachable assemblies and more particularly to novel hardware for easily attaching or removing portable members from stationary structures. A quick acting fastener assembly is described for attaching a portable member, such as a toilet seat, to a stationary member, such as a toilet bowl, for example. The portable member carries a pair of headed pins fixed to the margin thereof and projecting outward to mate with receptacles on the stationary member. Said pins and the mating receptacles are of a unique design such that when the pins are inserted into the matching receptacles the portable member is securely fastened to the stationary member, yet can be removed, disengaged, without any adjustments (levers pulled, fasteners removed, etc.). The distinguishing feature of this invention is in the simplicity of the mechanical hardware, the absence of moving parts, springs, fasteners, levers, or removable nuts, etc.

3 Claims, 3 Drawing Sheets

DETACHABLE TOILET SEAT

CROSS-REFERENCE TO RELATED APPLICATIONS

This application claims the benefit of the prior filed U.S. Provisional Application Serial No. 60/109,372 filed on Nov. 23, 1998.

FIELD OF THE INVENTION

This invention relates to fasteners for detachably connecting a removable member, such as a toilet seat, to a stationary member, such as a toilet bowl.

BACKGROUND AND SUMMARY OF THE INVENTION

It is frequently desirable to securely attach a removable member to stationary member in a way that positively secures the removable member but also allows the removable member to be quickly detached from and re-attached to the stationary member. For example, an improved mechanism for easily attaching and removing a toilet seat from a toilet bowl would facilitate installation, maintenance and cleaning, thus lowering costs and promoting sanitation.

It is accordingly a principle object of the present invention to positively secure a removable member, such as a toilet seat, to a stationary member, such as a toilet bowl, while permitting the removable member to be quickly detached and quickly re-installed.

It's a further object of the present invention removably attach a toilet seat to a toilet bowl without requiring the use of complex structures employing multiple moving parts, levers, bolts, slide mechanisms etc., thus reducing the cost of a removable toilet seat.

It is still another object of this invention to quickly and easily adjust the frictional force which must be applied in order to detach and re-install a toilet seat, so that the seat is effectively held in place during normal use but is also be easily removed to facilitate cleaning.

It is still a further object of the invention to convert a conventional toilet seat into a removable toilet seat by simply replacing the conventional fastener with a special fastener which permits the seat to be easily detached, without requiring any modification to either the seat or the toilet bowl.

It is another object of the invention to provide a simple, positive-acting, long-lasting, maintenance free, inexpensive fastener for interconnecting two members which incorporates manually operable means for force needed to attach and release of the two members.

In accordance with a feature of the invention, a novel fastener is employed for detachably connecting first and second members, such as a toilet seat and a toilet bowl. The fastener employs an elongated pin secured at one end to the first member and hollow elongated pin ptacle secured to the second member, the receptacle having deformable side walls which, when subjected to a constricting force, deflect inwardly to clamp and retain the pin within the receptacle. Means are preferably employed for adjusting the constricting force to vary the friction between the receptacle and the pin, thus adjusting the force that must be applied to attach and separate the two members. To provide the needed variable constricting force, the exterior of the pin receptacle is preferably threaded to receive and mate with a manually rotatable member which includes a bearing surface that adjustably engages with the deformable side walls when rotated.

The principles of the invention may be used to modify a conventional toilet bowl and toilet set assembly, allowing the seat to be readily removed from the bowl, and promoting sanitation by allowing the toilet seat and bowl to be more easily and completely cleaned. The conventional fasteners which are normally installed through seat mounting holes in the toilet bowl and in the toilet seat are replaced with the new detachable fasteners which use the same mounting holes. One end of an outwardly extending pin is secured to each mounting hole in the toilet seat, and a mounting receptacle is attached to each corresponding mounting hole in the toilet bowl. In accordance with the invention, a constricting force is applied to deflect the receptacle side walls to clamp each pin in place, and a manually adjustable bearing member is employed to adjust the constricting force to vary the friction between the receptacles and pins which secure the toilet seat to the toilet bowl.

These and other objects, features and advantages of the present invention may be better understood by considering the following detailed description of a preferred embodiment of the invention. In the course of this description, frequent reference will be made to the attached drawings.

DETAILED DESCRIPTION OF THE PREFERRED EMBODIMENT

The preferred embodiment of the invention is a detachable fastener, two of which may be used to advantage to removably attach a toilet seat to a toilet bowl. Each fastener consists of three specially-formed parts (a pin, a pin receptacle, and a captivation nut) which are attached to the toilet seat and bowl using two standard threaded hardware nuts.

Figure 1:
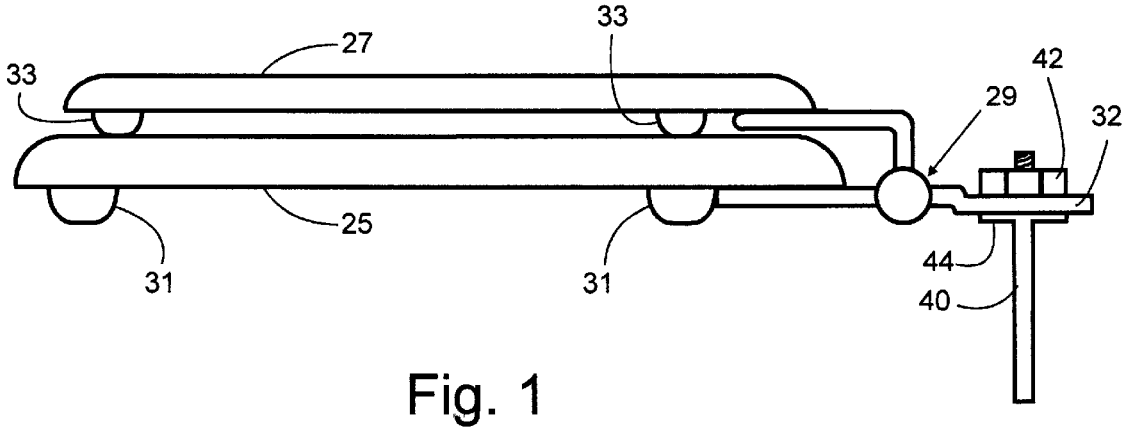
FIG. 1 is a side-elevational view of a conventional toilet seat to which the pin portion of the detachable fastener has been secured.
Figure 2:
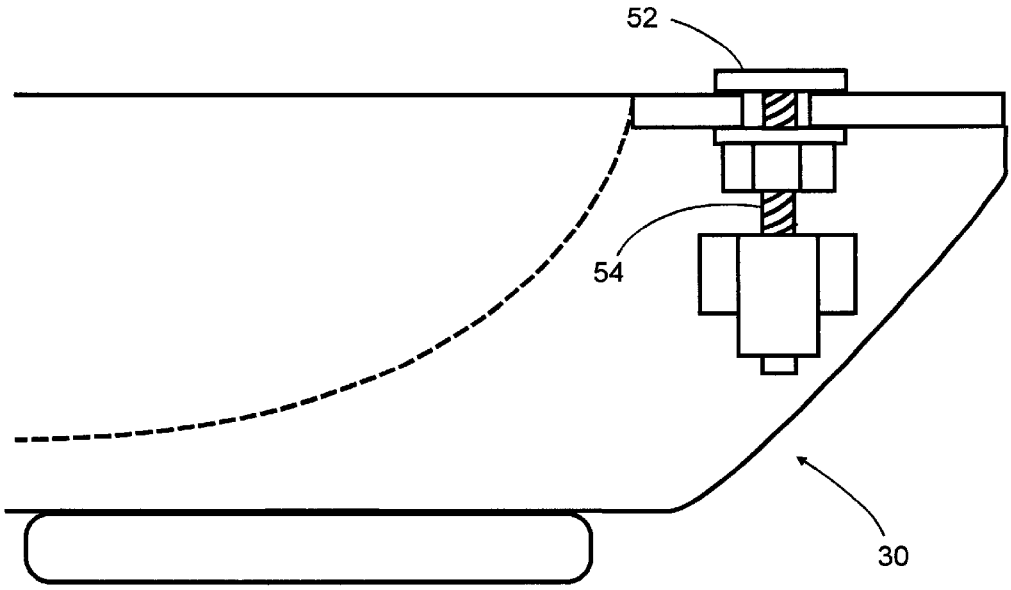
FIG. 2 is a side elevational view of a conventional toilet bowl, shown partially in cross-section, to which the pin receptacle portion of the detachable fastener has been secured.
Figure 3:
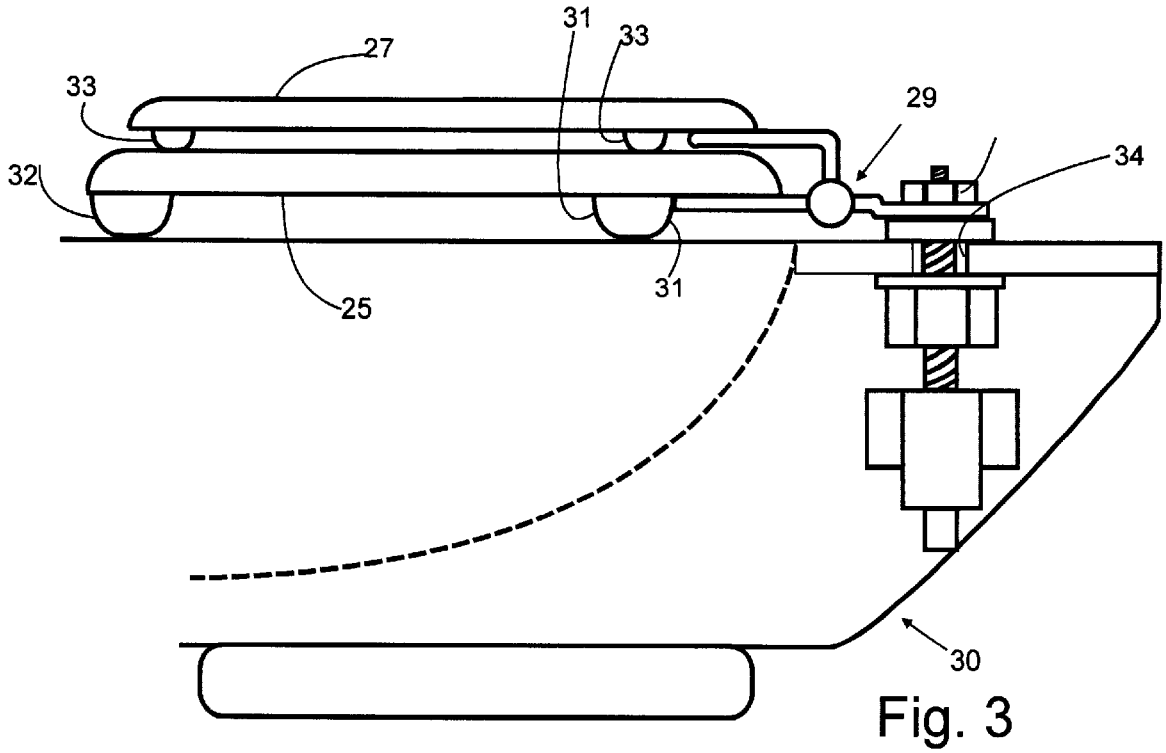
FIG. 3 is a side-elevational view showing the toilet seat attached to the toilet bowl by means of the detachable fastener.

The detachable fastener may be used with a conventional toilet assembly consisting of a seat 25, a seat lid 27, a lid hinge 29 and a toilet bowl 30 as seen in FIGS. 1–3. Conventional deformable seat bumpers 31 and lid bumpers 33 support the seat and lid when attached to a toilet bowl 40 as seen in FIG. 3. A pair of conventional mounting flanges seen at 32 extend outwardly from the lid hinge 29 to define seat mounting holes which align with corresponding mounting holes 34 in the toilet bowl 30 as seen in FIG. 3. In accordance with the invention, the conventional plastic nut-and-bolt fasteners (not shown) which are normally inserted through these mounting holes to secure the seat assembly flanges 32 to the bowl 30 may be advantageously replaced by the detachable fastener contemplated by the present invention in order to facilitate the removal and cleaning of the seat assembly and toilet bowl.

Figure 4:
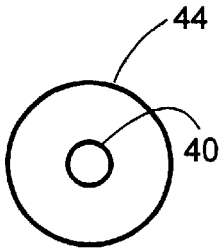
FIGS. 4 and 5 are end and side views respectively of the pin.
Figure 5:
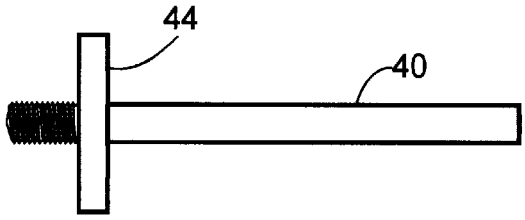
Figure 8:
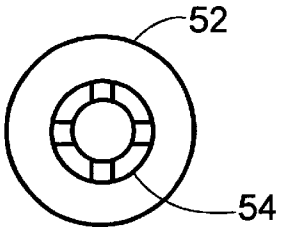
FIGS. 6–8 are first end, side and second end elevational views, respectively, of the pin receptacle.
Figure 7:
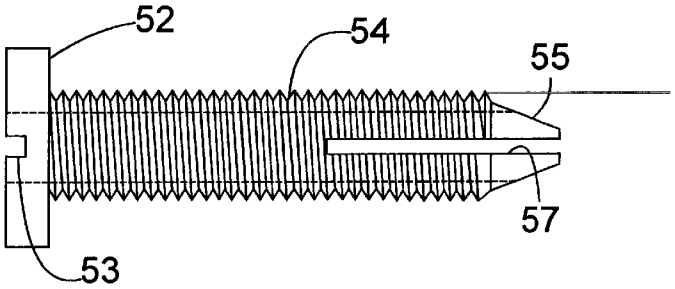
Figure 6:
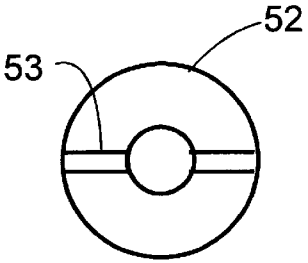

As seen in FIG. 1, a pin 40 is permanently attached to the flange 32 by a standard plastic flare-headed nut 42. The configuration of the pin 40 is depicted in FIGS. 4 and 5. Pin 40 is shaped to define an annular flange 44 near a first end of its ends, and is threaded between the flange 44 and that first end to receive the nut 42. The pin 40 is also preferably formed from a standard moldable plastic material similar to that used in to form the fasteners used by conventional toilet seats for permanent attachment. The distal and threaded portions of the pin 40 preferably have a 0.25 inch diameter. The annular flange 44 preferably has a diameter of 0.625 inches.

A pin receptacle assembly is attached to the toilet bowl 30 with a standard flare-headed nut 51 and receives the distal end of the pin 40. The receptacle assembly, shown attached to the toilet bowl 30 in FIG. 2, includes a hollow receptacle 54, shown separately in FIGS. 6–9, defines a central bore which receives the pin 40. The receptacle 54 is formed to include head flange 52 at one end whose outer face is provided with a transverse screwdriver slot 53 used when tightening the nut 51. The hollow receptacle 54 is tapered at its other end at 55. Four slots 57 are cut through the wall of receptacle 54 at the tapered end 55 to permit the receptacle to be inwardly deformed to adjustably clamp the pin 40 as described below. The receptacle 54 preferably has an overall length of 2.5 inches, a 0.175 inch inside diameter (before deformation), a 0.36 inch outside diameter. The diameter of the head 52 is preferably 0.95 inches.

Figure 11:
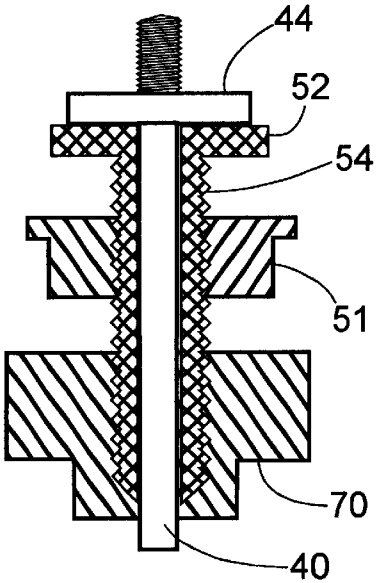
FIG. 11 is a cross-sectional view of the assembled fastener showing the pin in its captured position within the receptacle.

Similarly, the receptacle 54 has exterior threads which mate with the threads of the conventional flare-headed nut 51 seen in FIGS. 2 and 11. The receptacle 54 is inserted through the mounting hole 34 in the toilet 30 so that, when the nut 51 is tightened, the adjacent section of the toilet bowl 30 is tightly clamped between the nut 51 and receptacle's head flange 52, firmly securing the receptacle 50 to the bowl 30. Note that, at the time of first installation, the nut 51 is preferably fully tightened only after the seat and lid assembly are in place with the two pins 40 inserted into the two corresponding receptacles 54, thereby insuring that, when the nut 51 is tightened, the receptacles and pins will be properly aligned.

Figure 10:
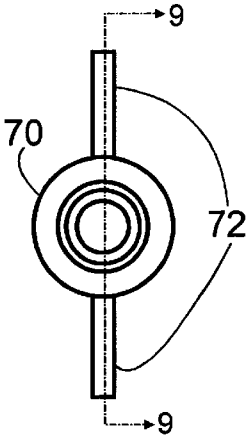
FIGS. 9–10 are cross-sectional and end elevational views respectively of the captivation nut.
Figure 9:
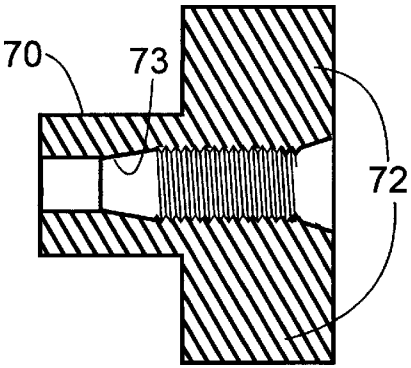

FIGS. 9 and 10 shows the design of a plastic captivation nut 70 which, as shown in FIGS. 2 and 11, screws onto and engages with the threaded, slotted end of the hollow receptacle 54. The captive nut 70 is provided with two outwardly projecting wing flanges at 72 which allow the nut 70 to be manually tightened to clamp the pin 40 against the inner sidewalls of the threaded receptacle 54. When the nut 70 is tightened, as seen in FIG. 11, the tapered end 55 of the receptacle 54 are drawn into contact with bearing surface defined by the interior bevel 73 (best seen in FIG. 9), deflecting the sidewalls of receptacle 54 axially inward to clamp the pin 40, thereby adjusting the frictional force required to slide the seat assembly secured by the fastener pin 40 onto the bowl secured receptacle.

The amount of force required to insert or remove the fastener pin 40 is adjusted by adjusting how far the captivation nut 70 is screwed onto the receptacle 54. Accordingly, the force required to attach or to remove the seat from the bowl can be varied by properly adjusting the tightness of the nut 70. In this way, the seat assembly may be secured against any lateral movement yet may be removed from the toilet bowl by applying only a moderate force to raise the seat assembly vertically, pulling the pair of seat fastener pins 40 out of two bowl receptacle receptacles 54. When the seat assembly is to be returned, the pins 40 may be reinserted and fully seated within the hollow receptacles 54 by applying a similar moderate downward force.

The detachable fastener shown in the drawings may be used to convert an existing toilet seat into a detachable toilet set. The conventional pair of plastic nuts and bolts normally used to attach the seat hinge to the bowl are simply removed and replaced with two detachable fasteners of the type described above. To attach each fastener, the nut 42 which secures the pin 40 to the lid hinge flange 32 is rotated into place, but initially left un-tightened. Similarly, the nut 51 which secures the receptacle 54 to the toilet bowl is also initially left un-tightened. After the seat assembly is in place, with the pins 40 inserted into the receptacles 54, which serves to align the pins and receptacles, the nuts 52 and 51 are tightened to secure the pins 40 and receptacles 54 respectively in their proper positions with respect to the seat and bowl. The captivation nut 70 is then tightened sufficiently to clamp the pin 40 against longitudinal movement within the receptacle 54 by applying a constricting force which deflects the sidewalls of receptacle 54 into tight frictional engagement with the pin 40. Once the captivation nut is rotated to the proper position to provide the desired frictional force, no further adjustment is necessary during normal use, and the seat may be periodically removed for cleaning and then replaced by simply disengaging and re-engaging the pins and pin receptacles.

It is to be understood that the preferred embodiment of the invention described above is merely one illustrative application of the principles of the invention. Numerous modifications may be made to the arrangement and procedures described without departing from the true spirit and scope of the invention.

What is claimed is:

1. A fastener for removably attaching a toilet seat assembly to a toilet bowl, said toilet seat assembly comprising a seat, a seat lid and a hinge for attaching said seat and said seat lid for independent pivotal motion with respect to said toilet bowl, said assembly including a mounting hole at each end thereof, said fastener comprising, in combination, two elongated pins each having a threaded end inserted through one of said mounting holes and being attached to said assembly by a pin-securing nut screwed onto said threaded end, two receptacles, each having deflectable side walls for receiving one of said pins, said receptacles being attached to said toilet bowl and positioned to align with said two pins, and means for applying a constricting force to deflect said side walls of each of said receptacles when said pins are inserted therein to frictionally clamp each of said pins in a fixed position within its surrounding receptacle to secure said seat hinge to said toilet bowl.

2. A fastener as set forth in claim 1 wherein said toilet bowl defines a pair of seat mounting holes and wherein each of said receptacles has a first threaded end adapted to be inserted through and attached to one of said seat mounting holes by a receptacle securing nut.

3. A fastener as set forth in claim 2 wherein each of said receptacles has a second threaded end opposite to said first threaded end adapted to receive a clamping nut which includes an internal bearing surface which applies said constricting force to said side walls when said clamping nut is screwed onto said second threaded end.

* * * * *